US009334028B2

(12) United States Patent
Ford et al.

(10) Patent No.: US 9,334,028 B2
(45) Date of Patent: May 10, 2016

(54) APPARATUS FOR SEALING A HOLE IN A WALL

(71) Applicants: Sam Ford, Bristol (GB); John Ford, Bristol (GB)

(72) Inventors: Sam Ford, Bristol (GB); John Ford, Bristol (GB)

( * ) Notice: Subject to any disclaimer, the term of this patent is extended or adjusted under 35 U.S.C. 154(b) by 0 days.

(21) Appl. No.: 14/414,119

(22) PCT Filed: Jul. 10, 2013

(86) PCT No.: PCT/GB2013/051818
§ 371 (c)(1),
(2) Date: Jan. 11, 2015

(87) PCT Pub. No.: WO2014/009719
PCT Pub. Date: Jan. 16, 2014

(65) Prior Publication Data

US 2015/0166154 A1 Jun. 18, 2015

(30) Foreign Application Priority Data

Jul. 11, 2012 (GB) ..... 1212318.8
May 7, 2013 (GB) ..... 1308192.2

(51) Int. Cl.
*B63B 43/16* (2006.01)
*B63B 9/00* (2006.01)

(52) U.S. Cl.
CPC . *B63B 43/16* (2013.01); *B63B 9/00* (2013.01); *Y10T 29/49732* (2015.01)

(58) Field of Classification Search
CPC ..... B63B 43/16
USPC ..... 114/227–228
See application file for complete search history.

(56) References Cited

U.S. PATENT DOCUMENTS 5,845 A * 10/1848 Seely ..... B63B 43/16 114/227
503,079 A * 8/1893 Gowen ..... B63B 43/16 114/227

(Continued)

FOREIGN PATENT DOCUMENTS

DE 1245786 B 7/1967
DE 19957445 A1 5/2001

(Continued)

OTHER PUBLICATIONS

IPO Search & Exam Report, dated Oct. 8, 2012 for GB1212318.8.

(Continued)

*Primary Examiner* — Lars A Olson
*Assistant Examiner* — Jovon Hayes
(74) *Attorney, Agent, or Firm* — Crose Law LLC; Bradley D. Crose

(57) ABSTRACT

An apparatus for sealing a hole in a wall (4), the wall in use dividing a region of relative high pressure from a region of relative low pressure, the apparatus comprising an elongate stem (2) connected at one end to a sealing member (3) which extends substantially radially from the major axis of said stem in an extended state such that, in use, said relative high pressure acts to seal the sealing member in the extended state against the wall, wherein said sealing member is resiliently deformable from said extended state into a collapsed state in which the sealing member is folded towards the stem, and into an everted state in which the sealing means is folded away from the stem. Said sealing member may when in its extended state form a dome shape which acts to maintain an air gap around the hole.

19 Claims, 6 Drawing Sheets

(56) References Cited

U.S. PATENT DOCUMENTS

| | | | | | |
|---|---|---|---|---|---|
| 1,411,560 | A * | 4/1922 | Beaty | A45B 19/02 | 135/20.2 |
| 2,220,085 | A * | 11/1940 | Dirschel | B63B 43/16 | 114/227 |
| 2,476,601 | A * | 7/1949 | Harper | B63B 43/16 | 114/227 |
| 4,385,582 | A * | 5/1983 | Fuerst | B63B 43/16 | 114/227 |
| 2015/0166154 | A1 * | 6/2015 | Ford | B63B 43/16 | 114/227 |

FOREIGN PATENT DOCUMENTS

| | | | |
|---|---|---|---|
| DE | 20204880 | U | 9/2002 |
| EP | 0335747 | A2 | 10/1989 |
| FR | 2259009 | A1 | 1/1974 |
| FR | 2574890 | A1 | 6/1986 |
| GB | 1450861 | A | 9/1976 |
| GB | 2432562 | A | 5/2007 |
| SU | 1110718 | A1 | 8/1984 |

OTHER PUBLICATIONS

PCT International Search Report, Oct. 21, 2013.
IPO Search & Exam Report, dated May 20, 2013 for GB1308192.2.

* cited by examiner

APPARATUS FOR SEALING A HOLE IN A WALL

FIELD OF THE INVENTION

This invention relates to the sealing of holes in walls, where said wall is a barrier between regions of differing pressure, e.g. a breach in a ship's hull, by the use of an elastomeric apparatus.

BACKGROUND OF THE INVENTION

In any pressurised vessel, the wall of the vessel represents a barrier between a region of relative high pressure and a region of relative low pressure. If the wall becomes breached there is typically a rapid transit of material through said breach as the two regions regain equilibrium.

This can have disastrous consequences, particularly in the field of boats and submarines where the transitting material is fluid (e.g. seawater) and can result in the vessel sinking. Submarines are of particular concern, as the water pressure increases with depth and gives a higher differential between the areas of relative high and low pressure, and this increases the rate of fluid transit in the event of a breach. Consequently, breaches must be repaired with urgency.

Presently, as is known in the art, breaches may be repaired temporarily with a set of bungs or dowels. Typically, the set of bungs are formed of wood or a plastics material with the bungs being of varying sizes to repair correspondingly sized breaches. When a bung is inserted into the breach, access to the hole is blocked and so for a full repair the vessel must be removed from the water (dry-docked) and the bung can be safely removed and the hole repaired.

Clearly, this known method of repairing breaches has a number of drawbacks. Firstly, a number of bungs must be carried on the vessel to accommodate different sizes of breach, which is inconvenient and can prevent the repairing of a second breach if the appropriately sized bung is already being used to repair a first breach. A given bung may only be used to repair a hole that closely matches the size of that particular bung. Having a plug that can be used to repair holes of various sizes would overcome this drawback.

Additionally, the bungs block access to the damaged area in use. This has the drawback that a full repair must be postponed until the vessel makes it back to the dock. This is risky, as bungs are held in place with mechanical force, and only friction prevents the bung from being pushed out of the hole. Consequently, bungs can fail if they are left in the breach for an extended period. Also, often a bung must be hammered into a breach to ensure a snug fit. This can put stresses on fault lines surrounding the breach, weakening these areas and risking failure of hull integrity. It would be beneficial to provide a plug that continues to provide access to the hole for repair in use. It would also be beneficial to provide a plug that does not require hammering to remain in place.

Other prior art apparatuses comprise 'umbrella'-type plugs, such as those disclosed in GB2432562, GB2217591 and GB1450861. These comprise sealing members which are inserted through the hole in a collapsed state and then expanded over the hole by the action of support struts, the sealing means then being clamped over the hole. These devices may be inserted through the hole from the region of relative low pressure, however to withdraw them back requires the sealing means to be collapsed again, which is not always feasible. Damage to a support strut can cause the sealing means to be locked in an expanded state, making the apparatus irretrievable through the hole. Said umbrella-type plugs also have the drawback that they rely on mechanical operating mechanisms to expand the sealing member—see, for example FIG. 2 of GB2432562, FIG. 5 of GB2217591, and FIG. 1 of GB1450861. If the operating mechanism fails the sealing member may cease to prevent the transit of material through the hole. This means that these types of plug have a risk of structural failure (a breach in the sealing member itself), plus an additional risk of mechanical failure. These umbrella-type plugs also suffer from the drawback that they must be installed with two hands: one to hold the plug and one to operate the mechanism. This can be a difficult operation to perform in confined spaces where access to the hole is restricted. It would be beneficial to provide a plug that can be inserted into, and retracted from, a hole with one hand.

As other prior art may be mentioned, DE20204880U, DE19957445, FR2574890, SU1110718, FR2259009 and US5845 all disclose various known apparatuses for sealing holes in walls which divide a region of relative high pressure from a region of relative low pressure.

The present invention aims to provide a sealing apparatus capable of overcoming the aforementioned drawbacks.

SUMMARY OF THE INVENTION

According to the present invention from one aspect, there is provided an apparatus for sealing a hole in a wall, the wall in use dividing a region of relative high pressure from a region of relative low pressure, the apparatus comprising an elongate stem connected at one Send to a sealing member which extends substantially radially from the major axis of said stem in an extended state such that, in use, said relative high pressure acts to seal the sealing member in the extended state against the wall, wherein said sealing member is resiliently deformable from said extended state into a collapsed state in which the sealing member is folded towards the stem, and into an everted state in which the sealing means is folded away from the stem.

The sealing member may optionally when in its extended state form a dome shape, which may act to maintain an air gap around the hole in use. Optionally, the stem portion could comprise strengthening rods. The stem portion could comprise a retaining means.

The sealing member and stem may be moulded as one piece.

A kit of parts comprising a plurality of such apparatuses is also claimed.

According to the invention from another aspect, there is provided a method of sealing a hole in the wall which divides a region of relative high pressure from a region of relative low pressure comprising the steps of:

providing a sealing apparatus, the sealing apparatus comprising an elongate stem connected at one end to a sealing member which extends substantially radially from the major axis of said stem in an extended state such that, in use, said relative high pressure acts to seal the sealing member in the extended state against the wall, wherein said sealing member is resiliently deformable from said extended state into a collapsed state in which the sealing member is folded towards the stem, and into an everted state in which the sealing means is folded away from the stem;

inserting the sealing member through the hole in its collapsed state until the sealing member clears the hole and reverts to its extended state, said relative high pressure acting to seal the sealing member in its extended state against the wall; and removing the sealing member through the hole in its everted state.

The sealing member may optionally when in its extended state form a dome shape, which may act to maintain an air gap around the hole in use. Optionally, the stem portion could comprise strengthening rods. The stem portion could comprise a retaining means.

The sealing member and stem may be moulded as one piece.

The method may comprise the further step of performing a repair operation on the hole between the steps of inserting the sealing member and removing the sealing member.

The insertion step may comprise pushing the stem from the region of relative low pressure towards the region of relative high pressure. The removal step may comprises pulling the stem from the region of relative high pressure towards the region of relative low pressure. Either of the insertion or removal steps, or both, may be performed with a force provided by an explosive charge or hydraulic ram.

The method may comprise the further steps of providing one or more additional sealing apparatuses, each sealing apparatus comprising a stem connected at one end to a sealing member which extends substantially radially from the major axis of said stem in an extended state, wherein said sealing member is resiliently deformable from said extended state into a collapsed state in which the sealing member is folded towards the stem, and into an everted state in which the sealing means is folded away from the stem; inserting the sealing member of each additional sealing apparatus through the hole in its collapsed state until the sealing member clears the hole and reverts to its extended state, said relative high pressure acting to seal the sealing member in its extended state against the wall; and removing the sealing member of each additional sealing apparatus through the hole in its everted state.

DETAILED DESCRIPTION OF THE INVENTION

FIGS. 1A-D shows views of an apparatus according to the invention from three different angles. The apparatus comprises a stem 2 and a sealing member 3 and is formed of an appropriate elastomeric or polymeric material, e.g. polyurethane. The sealing member is connected to the stem 2 at one end and, in the absence of any external force, extends substantially radially from the major axis of the stem 2 in an extended state. In this embodiment the sealing member 3 is in the form of a dome shape, the rim 1 of which is designed to seal against a wall in use. The apparatus is normally formed by moulding the stem 2 and sealing member 3 as one piece. This is shown in the cross-sectional view of FIG. 1D. However, the stem 2 and sealing member 3 may also take the form of two separate connected components.

Figure 1A:
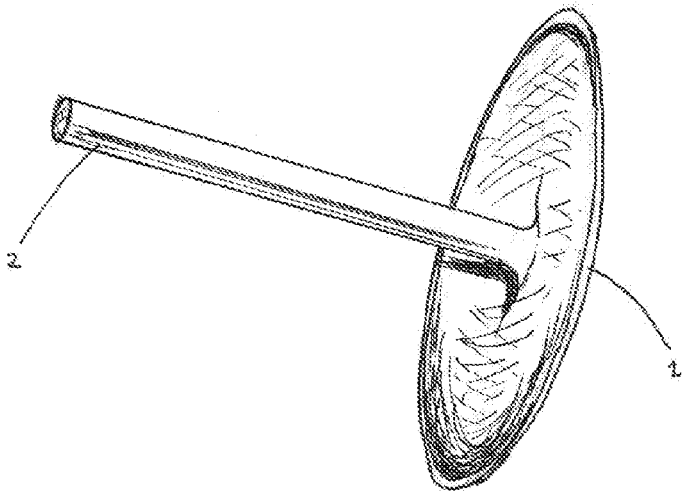
FIGS. 1A-D show four different views of an apparatus according to the invention: a perspective view, a plan view, a side view, and a cross-sectional view respectively.
Figure 1B:
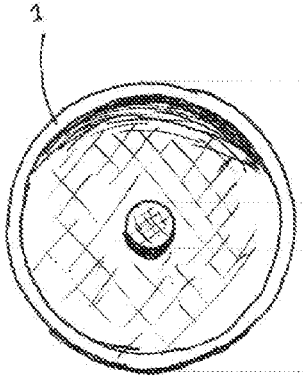
Figure 1C:
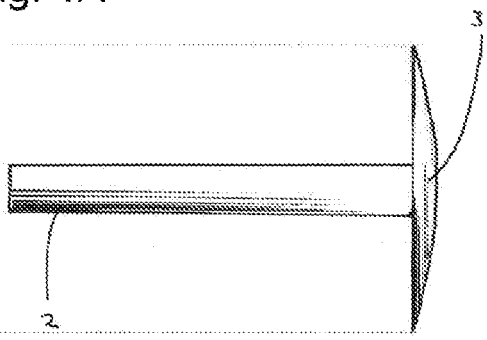
Figure 1D:
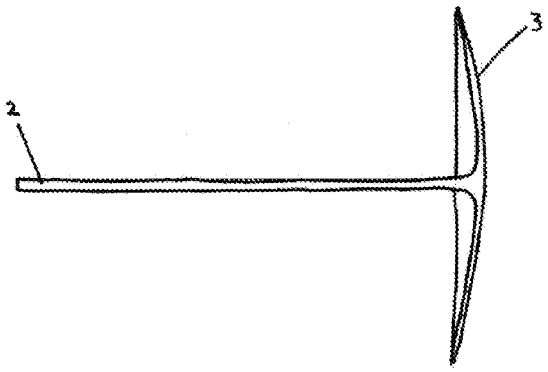
Figure 2:
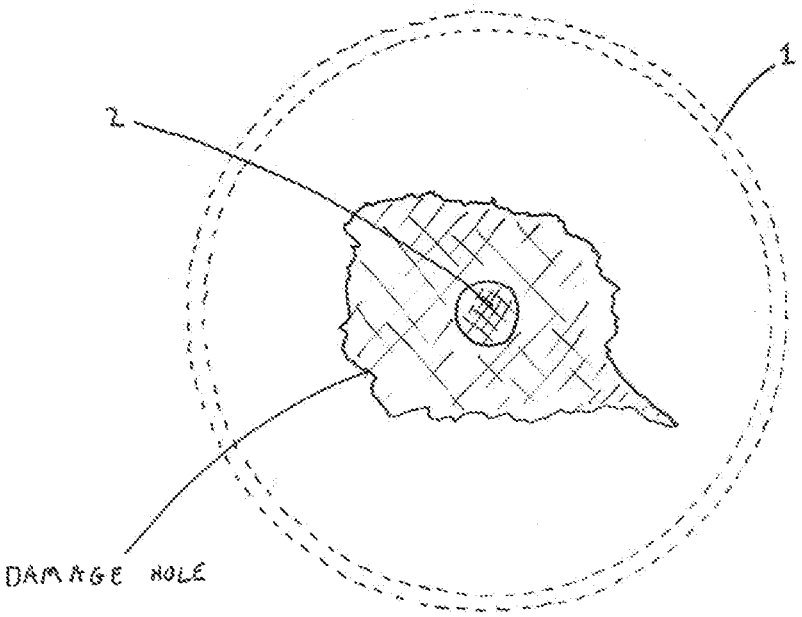
FIG. 2 shows a plan view of an apparatus according to the invention in use to seal a hole in a wall.

FIG. 2 shows an apparatus according to the invention in situ, i.e. following the step of inserting the sealing member 3 into a hole in a wall and extending the sealing member 3.

Figure 3:
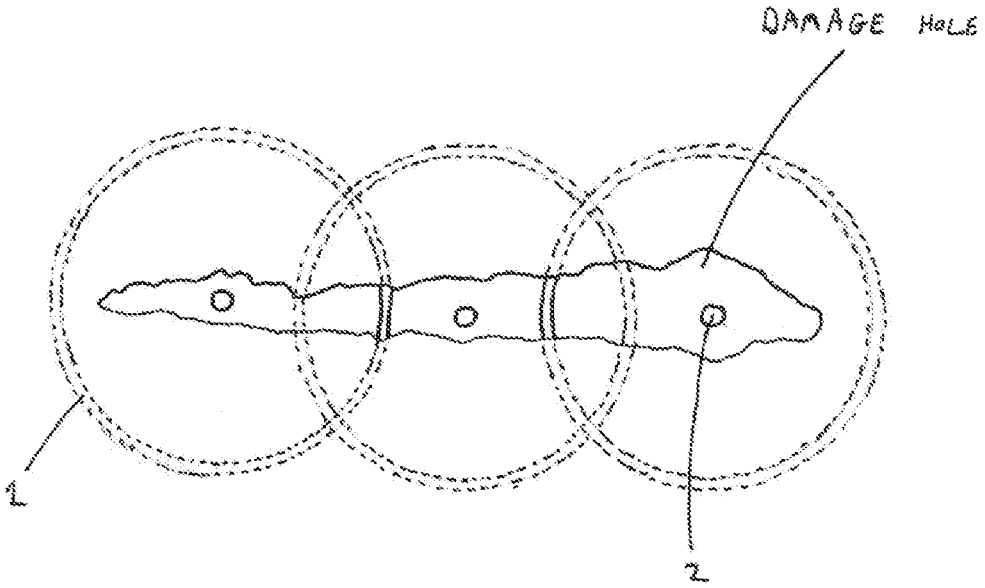
FIG. 3 shows a plan view of three apparatuses according to the invention being used in conjunction to seal a larger hole in a wall.

FIG. 3 shows the use of three apparatuses according to the invention being used in conjunction to seal a large hole. The rim 1 of each apparatus seals not only with the wall, but also with the sealing member of the adjacent apparatus to maintain a complete seal. Multiple plugs may be overlapped in this way to seal holes of various shapes and sizes.

Figure 4:
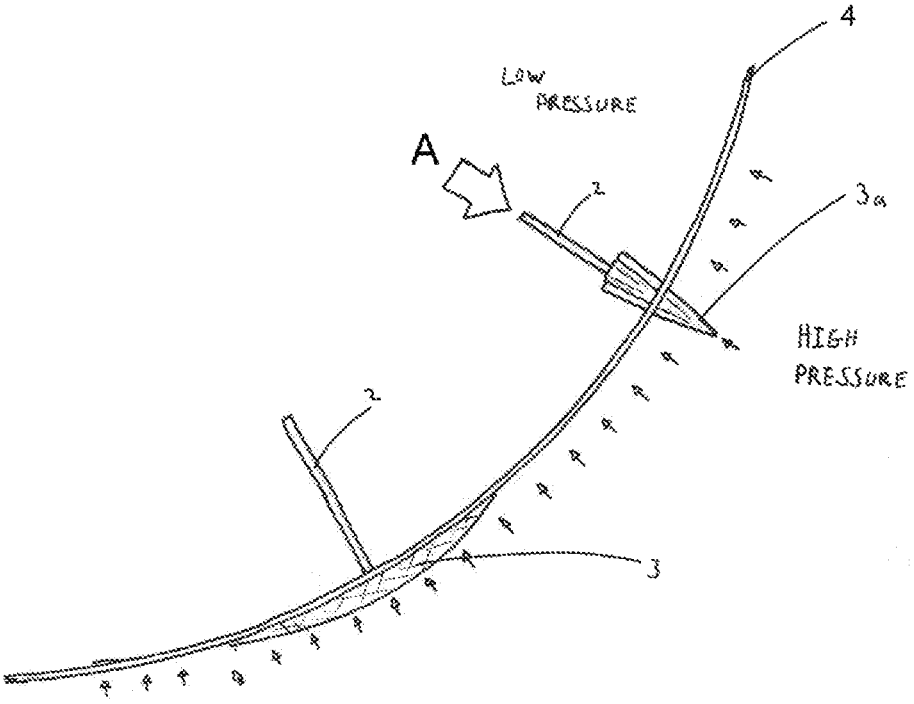
FIG. 4 schematically shows a side view of two apparatuses according to the invention, one in a collapsed state and one in an extended state.

FIG. 4 shows two apparatuses according to the invention. The sealing member of the upper apparatus is in the process of being inserted through a hole in a wall 4. A pushing force is being provided along the stem 2 in the direction of the arrow A. This causes the dome 3 to be resiliently deformed, i.e. folded, towards the stem 2 into a collapsed state 3*a* which allows it to pass through the hole. When the dome 3 is completely through the hole this force is removed and the sealing member 3 extends to an area larger than the hole. The pressure from the region of relative high pressure (indicated by the arrows to the right and below the wall 4) then acts to retain the sealing member 3 against the wall. The lower apparatus shows the sealing member extended and being retained against the wall 4. It can be seen in both embodiments that the sealing member 3 is inserted through the hole in a direction perpendicular to the wall 5.

In each embodiment of FIG. 4, the sealing member 3 when in its extended state forms a dome shape. An air gap is maintained around the hole by the shape of the dome. This allows access to the wall in the vicinity of the hole so that a repair operation may be performed if necessary. In this context, a repair operation may consist of, for example, welding or the replacement of a component.

Figure 5:
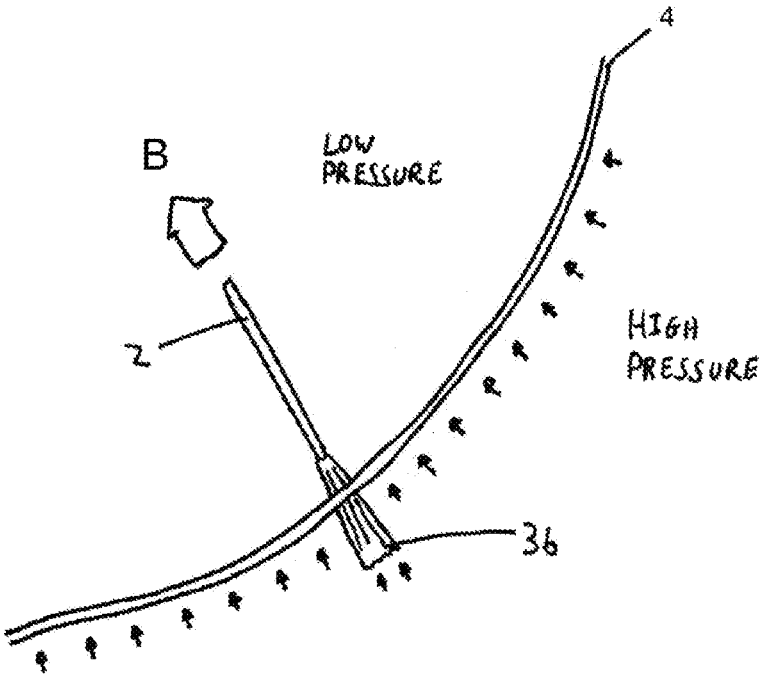
FIG. 5 schematically shows an apparatus according to the invention in an everted state.

FIG. 5 shows an apparatus according to the invention being removed from a hole in a wall 4. A pulling force is applied along the stem 2 in the direction of the arrow B. The sealing member 3 is everted by the wall 4 surrounding the hole as it is resiliently deformed, i.e. folded away from the stem 2. The sealing member in its everted state 3*b* has a smaller cross-sectional area than the hole and so it may pass back through the hole. To withdraw the sealing member through the hole, the pulling force along the stem must overcome the force acting to retain the dome against the wall of the vessel.

Figure 6:
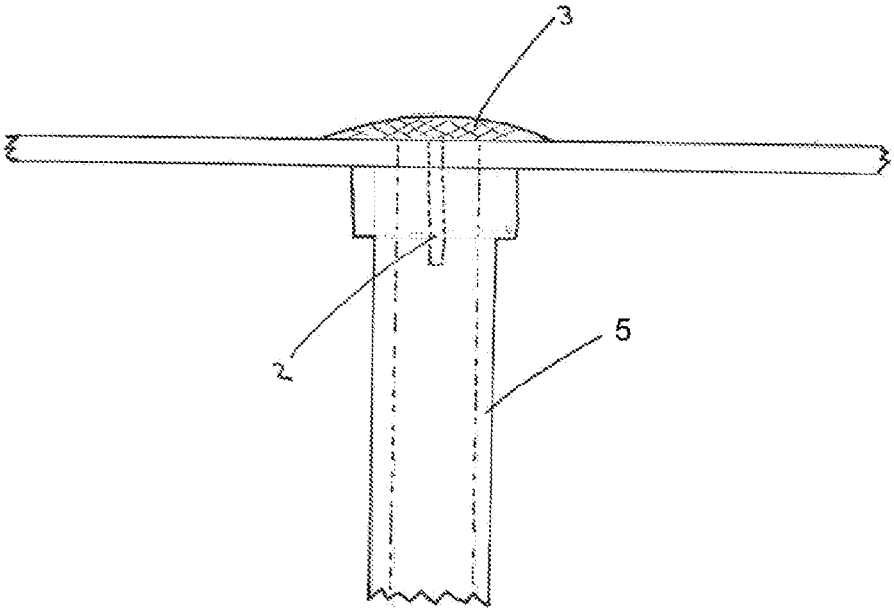
FIG. 6 schematically shows an apparatus according to the invention in use to seal a hole in a wall, having been inserted along a pipe.

FIG. 6 shows an apparatus according to the invention being used to repair a hole in a wall, the plug having been inserted along a pipe 5. Even though the cross-sectional area of the pipe 5 is smaller than that of the sealing member 3 in its extended state, the apparatus may be inserted along the pipe 5 with the sealing member 3 in its collapsed state. The insertion of the apparatus along pipes may be required in such procedures as, for example, seacock replacement in ships. Typically, this procedure requires the removal of the ship from the water in a dry-dock, and is hence time consuming and expensive to perform. However, the present invention would allow seacocks to be replaced while the ship is still in the water.

Figure 7A:
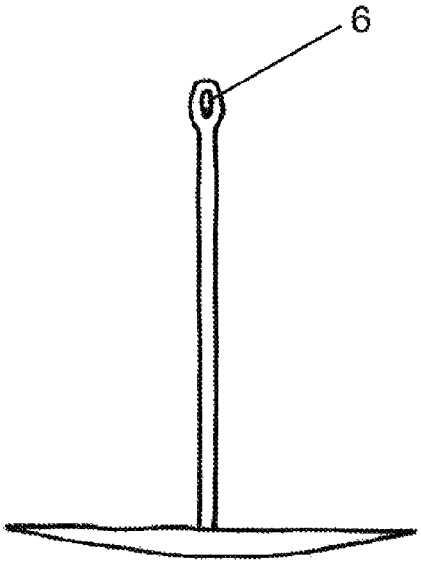
FIG. 7A shows a further embodiment of apparatuses according to the invention having retaining means in the stem.

FIG. 7A shows an embodiment of an apparatus according to the invention. The embodiment of FIG. 7A has an eyelet 6 formed in the stem which comprises a retaining means through which, for example, a cross-bar or rope may be passed. The retaining means may therefore act to prevent the plug from being lost through the hole, in the event that pressure is lost from the region of relative high pressure. This could be, for example, a temporary rarefaction from e.g. a wave or bubble, or it may result from the vessel being removed from the area of relative high pressure, e.g. a ship being lifted from the water.

Figure 7B:
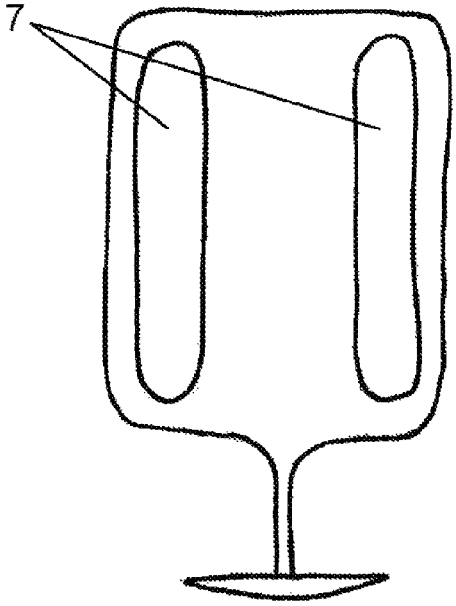
FIG. 7B shows a further embodiment of apparatuses according to the invention having a handle in the stem.

FIG. 7B shows an embodiment of an apparatus according to the invention. The embodiment of FIG. 7B has a handle 7 formed in the stem. The handle 7 aids the user in inserting and removing the apparatus from a hole. This is particularly useful when large forces must be applied to the stem to insert the sealing member through the hole, such as applications involving high pressures. The handle also makes it easier to insert and remove the apparatus using only one hand. In applications where the insertion force is too great to be applied by hand, the insertion force could be provided by an explosive charge, a hydraulic ram, or the like. The handle could be integrally formed in the stem by, for example, moulding, or it could be an additional component attached to the stem.

Figure 8:
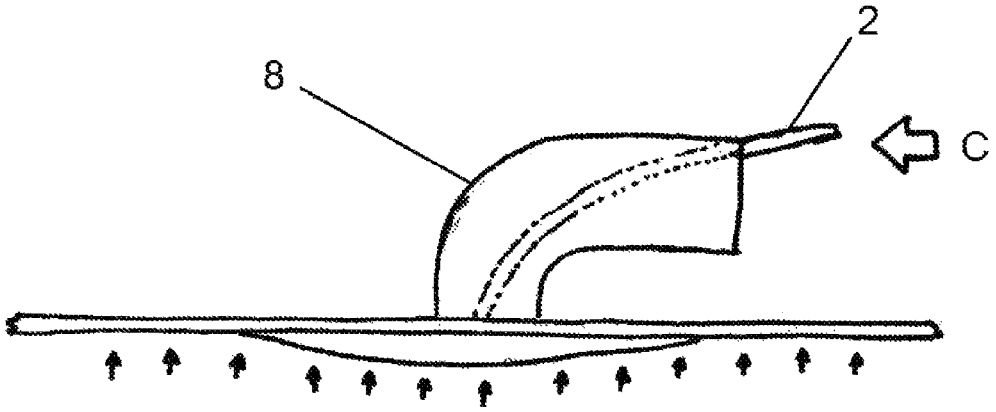
FIG. 8 schematically shows an apparatus according to the invention in use to seal a hole in a wall, having been inserted along a pipe which extends perpendicularly to the wall.

FIG. 8 shows an apparatus according to the invention being used to repair a hole in a wall, the plug having been inserted along a pipe 8 which extends perpendicularly to the wall. The stem 2 has sufficient flexibility that it can turn a corner of 90°, while still being rigid enough to transmit a force applied in the direction of arrow C along the stem 2 to the sealing member on insertion.

Figure 9:
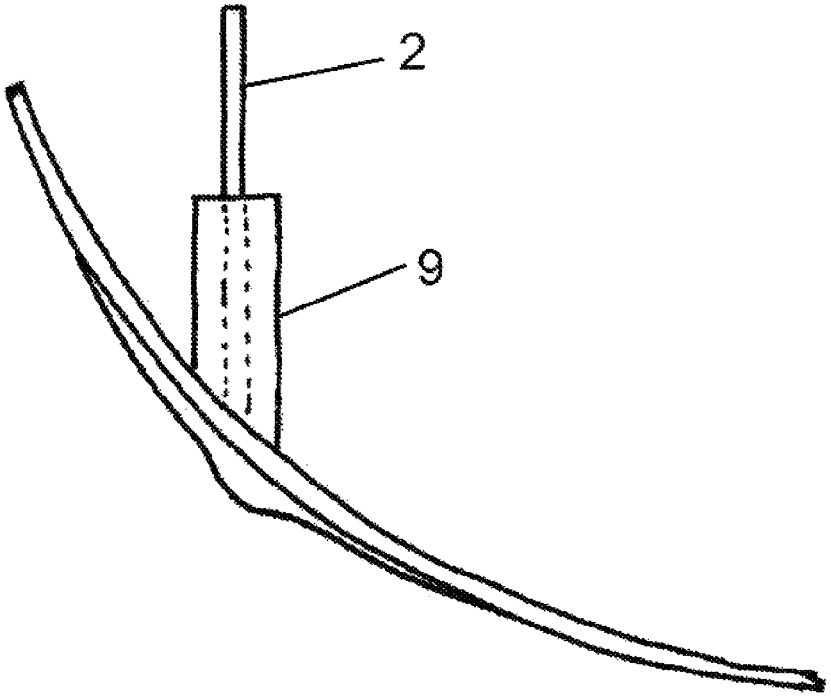
FIG. 9 schematically shows an apparatus according to the invention in use to seal a hole in a wall, having been inserted along a pipe which extends at an oblique angle to the wall.

FIG. 9 shows an apparatus according to the invention being used to repair a hole in a wall, the plug having been inserted along a pipe 9 which extends at an oblique angle to the wall.

Figure 10:
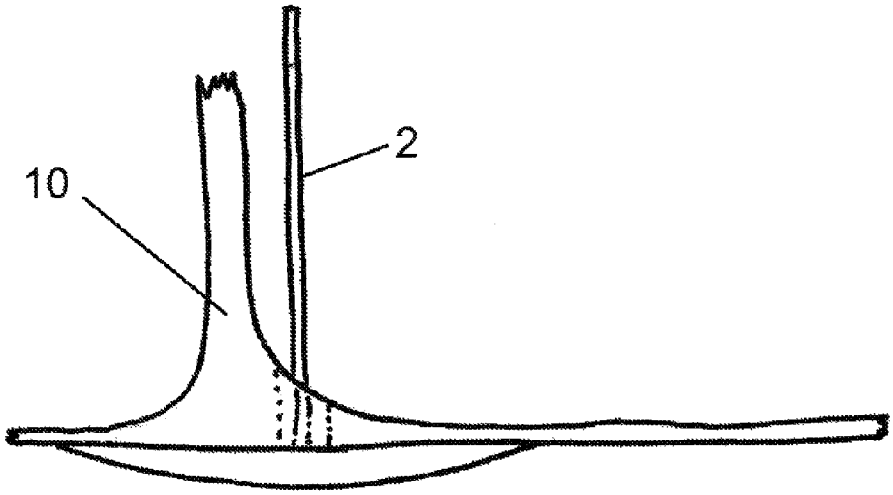
FIG. 10 schematically shows an apparatus according to the invention in use to seal a hole in a wall which has varying thickness in the area surrounding the hole.

FIG. 10 shows an apparatus according to the invention in use to seal a hole in a wall. Due to T-member 10 the wall in the area surrounding the hole has varying thickness.

Figure 11:
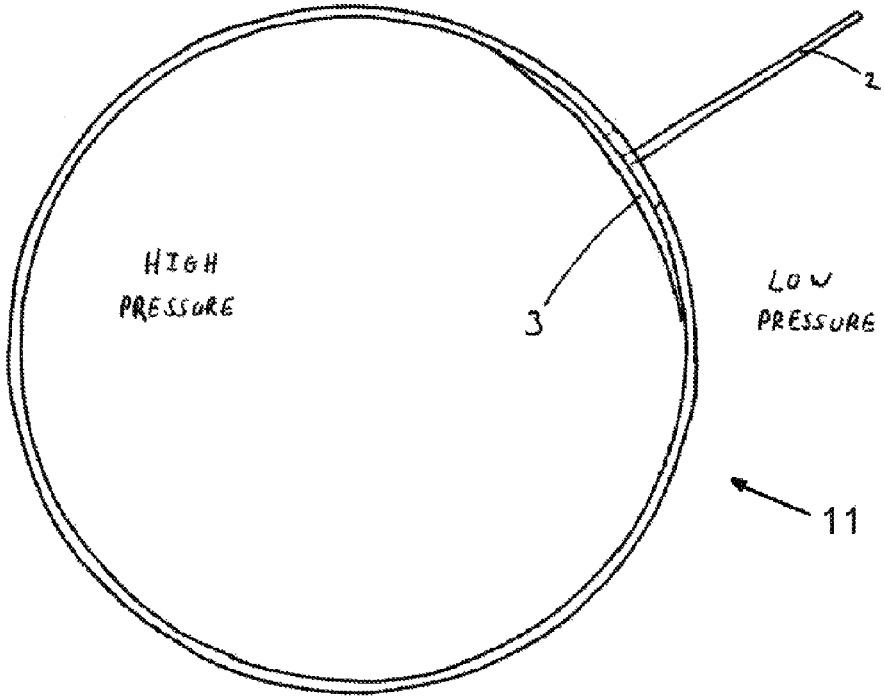
FIG. 11 schematically shows an apparatus according to the invention in use to seal a hole in a wall of a pressurised container.

FIG. 11 shows an apparatus according to the invention in use to seal a hole in a wall of a pressurised container 11. As the fluid inside the container 11 is highly pressurised, the apparatus is inserted through the hole from outside the container 11. It can also be seen that the wall of the container 11 comprises a curved surface, against which the sealing member seals in use. Note, additionally, that in this embodiment the wall of the pressurised container 11 need not be rigid, as the sealing member may self-adjust in shape to seal against walls which flex, for example the walls of emergency fuel tanks or bladders.

In any of the embodiments shown in FIGS. 1 to 11, the stem may also optionally comprise strengthening rods (not shown) made from e.g. glass fibres, metal, etc. to aid the application of force along the stem and prevent it from buckling. This is particularly useful in applications involving high pressure differentials between the regions of relative low pressure and relative high pressure. Additionally, the sealing member may optionally comprise a composite weave (not shown) of, for example, Kevlar® integrated into it to give the sealing member more rigidity (while retaining flexibility) and prevent it from stretching.

The above described embodiment is exemplary only, and other possibilities will be apparent to those skilled in the art. For example, although the above embodiment is primarily directed towards repairing holes in ships, it could be used in any applications which involve pressurised vessels, such as domestic boilers, tankers containing pressurised fluids, etc.

The invention claimed is:

1. An apparatus for sealing a hole in a wall, wherein said wall is a barrier between a first and second region, each region having a fluid pressure, the fluid pressure of the first region being greater than the fluid pressure of the second region, the apparatus comprising an elongate stem connected at one end to a sealing member which extends substantially radially from the major axis of said stem in an extended state such that, in use, the fluid pressure in the first region acts to seal the sealing member in the extended state against the wall, wherein said sealing member is resiliency deformable from said extended state into a collapsed state in which the sealing member is folded towards the stem, and into an everted state in which the sealing means is folded away from the stem.

2. An apparatus according to claim 1, wherein the sealing member forms a dome shape in the extended state.

3. An apparatus according to claim 2, wherein said dome shape acts to maintain an air gap around the hole in use.

4. An apparatus according to any of claim 1, wherein the stem portion comprises strengthening rods.

5. An apparatus according to claim 1, wherein the stem portion comprises a retaining member.

6. An apparatus according to claim 1, wherein the stem and the sealing member are moulded as one piece.

7. A method of sealing a hole in a wall wherein said wall is a barrier between a first and second region, each region having a fluid pressure, the fluid pressure of the first region being greater than the fluid pressure of the second region, the method comprising the steps of: providing a sealing apparatus according to claim 1, the sealing apparatus comprising an elongate stem connected at one end to a sealing member which extends substantially radially from the major axis of said stem in an extended state, wherein said sealing member is resiliently deformable from said extended state into a collapsed state in which the sealing member is folded towards the stem, and into an everted state in which the sealing means is folded away from the stem;

inserting the sealing member through the hole in its collapsed state until the sealing member clears the hole and reverts to its extended state, said fluid pressure in said first region acting to seal the sealing member in its extended state against the wall; and removing the sealing member through the hole in its everted state.

8. A method according to claim 7, wherein the insertion step comprises pushing the stem from the second region towards the first region.

9. A method according to claim 7, wherein the removal step comprises pulling the stem from the first region towards the second region.

10. A method according to claim 7, further comprising the step of: performing a repair operation on the hole with the plug inserted, between the steps of inserting and removing the sealing member.

11. A method according to claim 7, wherein the sealing member and the stem are moulded as one piece.

12. A method according to claim 7, wherein the insertion step is performed with a force provided by an explosive charge or hydraulic ram.

13. A method according to claim 7, wherein the removal step is performed with a force provided by an explosive charge or hydraulic ram.

14. A method according to claim 7, further comprising the steps of: providing one or more additional sealing apparatuses, each sealing apparatus comprising a stem connected at one end to a sealing member which extends substantially radially from the major axis of said stem in an extended state, wherein said sealing member is resiliently deformable from said extended state into a collapsed state in which the sealing member is folded towards the stem, and into an everted state in which the sealing means is folded away from the stem; inserting the sealing member of each additional sealing apparatus through the hole in its collapsed state until the sealing member clears the hole and reverts to its extended state, said pressure in said first region acting to seal the sealing member in its extended state against the wall; and removing the sealing member of each additional sealing apparatus through the hole in its everted state.

15. A method according to claim 7, further comprising the steps of: inserting the sealing member through one or more parts in its collapsed state until the sealing member clears the part(s) and reverts to its extended state, said pressure in said first region acting to seal the sealing member in its extended state against the wall; removing one or more parts through which the apparatus was inserted; and removing the sealing member through the hole in its everted state.

16. A method according to claim 7, further comprising the steps of: inserting the sealing member through the hole in its collapsed state until the sealing member clears the hole and reverts to its extended state, said pressure in said first region acting to seal the sealing member in its extended state against the wall; fitting over the stem of one or more parts through which the apparatus will be removed; and removing the sealing member through the hole and part(s) in its everted state.

17. A method according to claim 7, further comprising the steps of: inserting the sealing member through one or more parts in its collapsed state until the sealing member clears the part(s) and reverts to its extended state, said pressure in said first region acting to seal the sealing member in its extended state against the wall; removing one or more parts through which the apparatus was inserted; fitting over the stem of one or more parts through which the apparatus will be removed; and removing the sealing member through the hole and part(s) in its everted state.

18. A method according to claim 7, wherein the insertion step is performed with a single extremity.

19. A method according to claim 7, wherein the removal step is performed with a single extremity.

* * * * *